US006540379B2

(12) United States Patent
Ooms et al.

(10) Patent No.: US 6,540,379 B2
(45) Date of Patent: Apr. 1, 2003

(54) ELECTRIC LAMP/REFLECTOR UNIT

(75) Inventors: Leo Frans Maria Ooms, Turnhout (BE); Marcus Petrus Anna Jozef Van Opstal, Turnhout (BE)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/781,503

(22) Filed: Feb. 12, 2001

(65) Prior Publication Data

US 2001/0053080 A1 Dec. 20, 2001

(30) Foreign Application Priority Data

Feb. 15, 2000 (EP) ..... 00200497
Feb. 18, 2000 (EP) ..... 00200556

(51) Int. Cl.[7] ..... F21V 17/10

(52) U.S. Cl. ..... 362/263; 362/267; 362/296; 362/350

(58) Field of Search ..... 362/263, 267, 362/296, 350

(56) References Cited

U.S. PATENT DOCUMENTS 3,825,742 A * 7/1974 Levin ..... 362/296
4,241,391 A * 12/1980 Pitkjaan et al. ..... 313/579
4,389,700 A * 6/1983 Blaisdell et al. ..... 362/296
4,390,935 A * 6/1983 Audesse et al. ..... 362/226
5,206,558 A * 4/1993 Losonczi et al. ..... 313/113
5,353,210 A * 10/1994 Strok et al. ..... 362/293

FOREIGN PATENT DOCUMENTS

DE 3002085 7/1981 ..... F21V/7/22
EP 0595412 A1 5/1994 ..... H01J/61/34
WO WO9853475 11/1998 ..... H01J/1/02

OTHER PUBLICATIONS

Properties of Vycor http://www.corning.com/lightingmaterials/products.vycor.html.*
Properties of Vycor–UV http://www.corning.com/lightingmaterials/products/vycor–uv.html.*
Properties of Pyrex http://www.corning.com/lightingmaterials/products/pyrex.html.*
Properties of Borosilicate Lenses and Reflector http://www.corning.com/lightingmaterials/products/par.html.*

* cited by examiner

*Primary Examiner*—Sandra O'Shea
*Assistant Examiner*—Ismael Negron
(74) *Attorney, Agent, or Firm*—Frank J. Keegan

(57) ABSTRACT

An electric lamp/reflector unit has a molded reflector body which has a hollow neck-shaped portion. The electric lamp has a lamp vessel, enclosing a space in which an electric element is arranged. The lamp vessel has a first and a second, opposed end portion and is fixed with its first end portion within the neck-shaped portion. The molded reflector body is made of a temperature shock resistant glass-ceramic material with low coefficient of expansion.

6 Claims, 1 Drawing Sheet

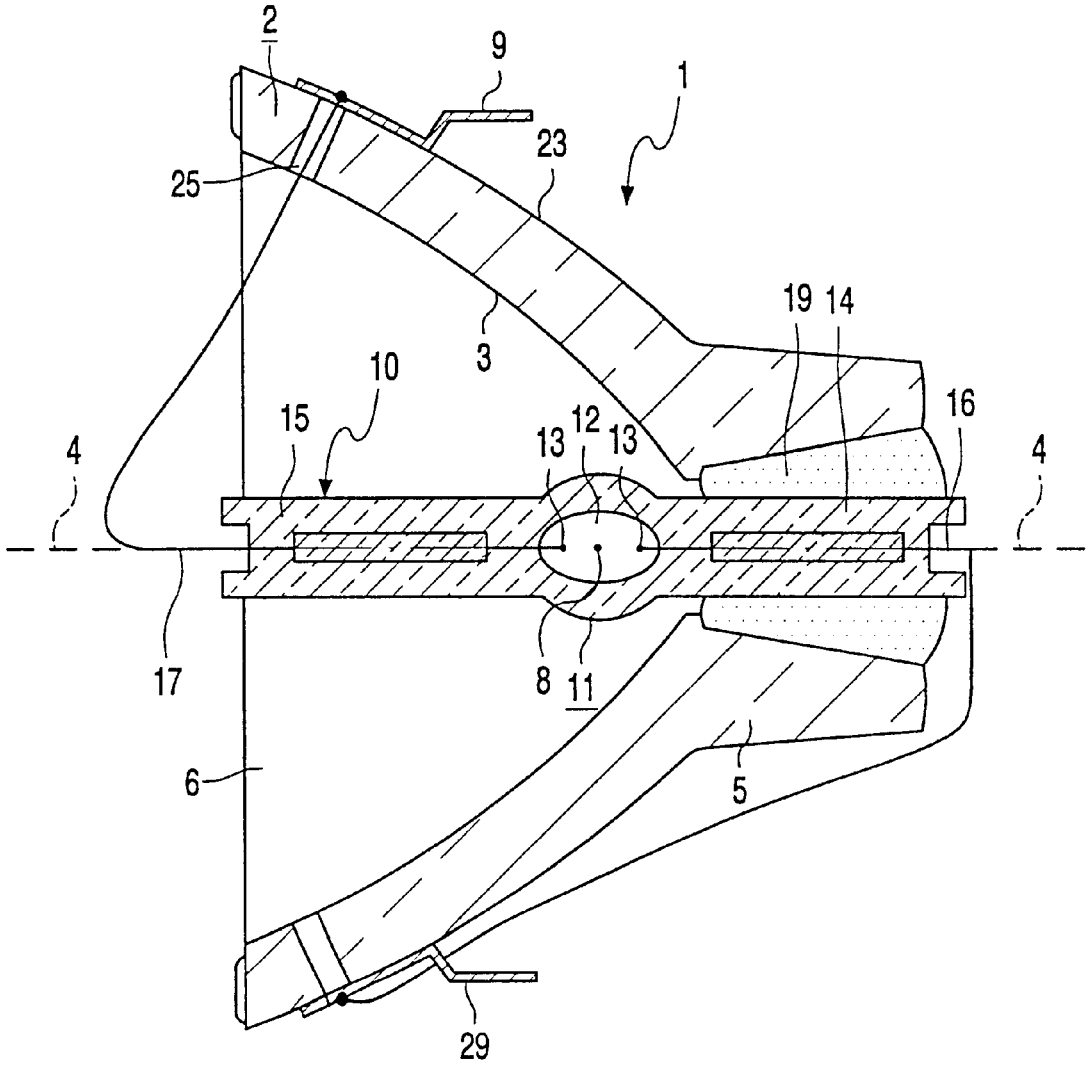
2
9
1
23
25
19
14
3
10
16
15
12
13
13
4
4
17
8
11
6
5
29

ELECTRIC LAMP/REFLECTOR UNIT

FIELD OF THE INVENTION

The invention relates to an electric lamp/reflector unit comprising:

a molded reflector body provided with a reflector portion with a focus, with an optical axis, and with a concave reflecting inner surface between a neck-shaped portion and a light emission window which is transverse to the optical axis;

an electric lamp provided with a light-transmitting lamp vessel which is closed in a vacuumtight manner and which has a cavity in which an electric element is arranged, and which has a first and a second end portion which are mutually opposed and have respective seals through which a respective first and second current conductor connected to the electric element issue from the lamp vessel to the exterior, the electric lamp being fixed in the reflector body with its first end portion in the neck-shaped portion, the cavity within the reflecting portion, and the electric element in the focus and on the optical axis.

BACKGROUND OF THE INVENTION

Such an electric lamp/reflector unit is known from EP 595412. Units of this kind may be used for projection purposes, for example film or slide projection, but they may also be used in projection TV equipment. Users of such projection equipment continuously strive for an improved safety and miniaturization of the equipment. There is also a wish for this miniaturization to take place without an accompanying loss of screen lumens. Such a loss of screen lumens may occur, for example, owing to a decrease in the size of the reflecting surface. Such a loss of screen lumens may also result from a comparatively inaccurate positioning of the electric element in the reflector body, whereby the light generated by the lamp is less well aimed and concentrated into a beam by the reflector body. It is a disadvantage of the known lamp/reflector unit that the positioning of the electric element is comparatively inaccurate. A further disadvantage of the known lamp/reflector unit is that a possible explosion of the lamp involves the risk of the reflector body cracking and/or fracturing owing to this explosion.

SUMMARY OF THE INVENTION

It is an object of the invention to provide an electric lamp/reflector unit of the kind described in the opening paragraph which can be manufactured comparatively inexpensively and easily, in which a comparatively accurate positioning of the electric element in the reflector body is obtained, and which is comparatively well resistant to a possible explosion of the lamp.

According to the invention, this object is achieved in that the electric lamp/reflector unit of the kind described in the opening paragraph is characterized in that the reflector body is manufactured from a glass-ceramic material with a coefficient of thermal expansion of between $-2\times10^{-6}$ $K^{-1}$ and $3\times10^{-6}$ $K^{-1}$. Such a coefficient of thermal expansion represents an average coefficient of thermal expansion over a temperature range of 0 to 500° C. The reflector body has a better thermal shock resistance when the reflector body manufactured from a glass-ceramic material with such a coefficient of expansion is used. The term "coefficient of expansion" used in this specification is the linear coefficient of expansion.

The glass-ceramic material is obtained by a comparatively simple and inexpensive process comprising a partial crystallization of a glass suitable for this purpose. Known multi-phase systems from which such glass-ceramic materials are known are, for example, $Li_2O—SiO_2—Al_2O_3$, $Li_2O—SiO_2—Al_2O_3—P_2O_5$, $Na_2O—ZrO_2—SiO_2—P_2O_5$, and $Li_2O—SiO_2—Al_2O_3—MO$, with M being, for example, Mg, Zn, Ca, and/or Ba. Known glass-ceramic materials are, for example, $LiAlSiO_4—LiAlSi_2O_6$, and $Mg_2Al_4Si_5O_{18}$. To obtain a reflector body made from glass-ceramic material, a reflector body of glass is first manufactured. Then the reflector body is brought to a temperature at which a crystallization of the glass commences. The reflector body is subsequently kept at this temperature for some time, for example a few hours, until a glass-ceramic material with a sufficient degree of crystallization has been obtained, whereupon it is cooled down. The reflector body of glass-ceramic material is thus obtained in a comparatively simple and inexpensive manner, and has a bulk composition of a mixture of a crystalline phase and a glass phase.

The quantity of screen lumens obtained from the lamp/reflector unit is strongly dependent on the positioning of the electric element of the lamp with respect to the focus of the reflector body. During assembly of the lamp/reflector unit, the lamp is placed in an aligned position in the reflector body, such that the electric element is positioned in the focus. Usually this positioning takes place while the lamp/reflector unit is not being operated, i.e. the lamp/reflector unit is comparatively cold. When switched on, the lamp/reflector unit will heat up, and respective components of the lamp/reflector unit, such as the reflector body and the lamp, will expand, thus causing changes in the relative positions of the components. The change in position of the electric element relative to the focus depends on the difference in coefficient of thermal expansion between the lamp and the reflector body. If there is a comparatively great difference in expansion, because the lamp/reflector unit becomes comparatively hot while the coefficients of thermal expansion differ comparatively much from one another, for example at differences of more than $2.5\times10^{-6}$ $K^{-1}$ over a temperature range of at least 400° C., there will be a too great change in the position of the electric element with respect to the focus of the reflector body. The lamp is manufactured from quartz glass, i.e. glass having an $SiO_2$ content of at least 95% by weight, which has a coefficient of thermal expansion of approximately $0.6\times10^{-6}$ $K^{-1}$. Since the reflector body is manufactured from a glass-ceramic material with a coefficient of expansion which corresponds roughly to the coefficient of thermal expansion of quartz glass, i.e. between $-2\times10^{-6}$ $K^{-1}$and $3\times10^{-6}$ $K^{-1}$, an acceptably small change in the mutual positioning of the electric element and the focus will occur. A comparatively large quantity of screen lumens is thus obtained from the lamp/reflector unit according to the invention.

Said change is also dependent on the temperature difference between the lamp and the reflector body arising during operation of the lamp/reflector unit. The lamp then becomes comparatively hot as compared with the reflector body. It is favorable when the coefficient of expansion of the reflector body is somewhat greater than that of the lamp so as to obtain an expansion of both components such that the electric element at least substantially does not become shifted with respect to the focus. Preferably, the glass-ceramic material has a coefficient of expansion of between $1\times10^{-6}$ $K^{-1}$ and $2\times10^{-6}$ $K^{-1}$. Such a coefficient of thermal expansion represents an average coefficient of thermal expansion over a temperature range of 0 to 500° C. Given such values for the coefficient of expansion of the glass-ceramic material, the electric element will remain at least substantially positioned in the focus. A larger quantity of screen lumens can thus be obtained from the lamp/reflector unit according to the invention.

Experiments have also shown that the reflector body has an improved temperature resistance and is better resistant to a possible explosion of the lamp. Since the coefficients of thermal expansion of the glass-ceramic material of the reflector body and the quartz glass of the lamp differ comparatively little from one another, the temporary mechanical stresses arising during operation of the lamp/reflector unit are comparatively small. On the other hand, this renders possible the use of the reflector body at a comparatively high temperature, for example of up to approximately 700° C. instead of 450° C. as with the use of a glass reflector body, while the safety of the lamp/reflector unit is retained.

A reflector for a lighting unit is known from DE-3002085 A1, wherein the reflector is manufactured from a ceramic material having a low coefficient of expansion. The manufacture of such a reflector, however, is labor-intensive and comparatively expensive. A further disadvantage is that an accurate shape of the reflector is difficult to realize.

WO 98/53475 describes a reflector manufactured from a quartz-ceramic material. A disadvantage of such a reflector is that the reflector is to be manufactured in a labor-intensive and comparatively expensive process which has a high reject percentage.

The electric element may be an incandescent body, for example in an inert gas comprising halogen, or a pair of electrodes in an ionizable gas.

BRIEF DESCRIPTION OF THE DRAWINGS

An embodiment of the electric lamp/reflector unit according to the invention is shown diagrammatically in axial sectional view in the FIGURE.

DETAILED DESCRIPTION OF THE PREFERRED EMBODIMENTS

In the FIGURE, the electric lamp/reflector unit has a molded reflector body 1 which is provided with a reflector portion 2 having an optical axis 4 and with a hollow neck-shaped portion 5 surrounding the optical axis 4. The reflector portion 2 further comprises a concave, for example paraboloidally curved, reflecting inner surface 3 between the neck-shaped portion 5 and a light emission window 6 which is transverse to the optical axis 4. The reflector body has a focus 8 situated within the reflector portion 2 and on the optical axis 4. In an alternative embodiment, however, said inner surface 3 may be, for example, ellipsoidal in shape. In the drawing, the reflector body 1 is made of a glass-ceramic material, for example of $LiAlSiO_4$—$LiAlSi_2O_6$, and has a mirroring layer formed by a metal layer, for example an aluminum layer. The lamp/reflector unit also comprises an electric lamp 10 which is provided with a light-transmitting lamp vessel 11 which is closed in a gastight manner and which is made, for example, of quartz glass or alternatively of a ceramic material, for example densely sintered aluminum oxide. The lamp vessel 11 has a cavity 12 in which an electric element 13, a pair of electrodes in the FIGURE with an electrode interspacing of 0.5–1.5 mm, for example 1 mm, is arranged. The lamp vessel 11 has a first 14 and a second, opposed end portion 15 with respective seals, through which seals a respective first 16 and second current conductor 17 connected to the electric element 13 are passed so as to issue from the lamp vessel 11 to the exterior. The lamp 10 shown is a high-pressure mercury gas discharge lamp which has a pressure of 180 bar or more during operation. A filling is furthermore accommodated in the cavity 12 of the lamp vessel 11, comprising mercury and a rare gas, for example argon, and bromine. The electric lamp 10, which has a rated power of between approximately 70 and approximately 150 W, is fixed in the reflector body 1, by means of cement 19 in the FIGURE, with its first end portion 14 in the neck-shaped portion 5, the cavity 12 within the reflecting portion 2, and the electric element 13 in the focus 8 and on the optical axis 4.

The current conductor 17 issuing from the second end portion 15 is passed through an opening 25 in the reflector portion 2 to the exterior, where it is connected to a contact member 9 which is provided on an outer surface 23 of the reflector portion 2. The current conductor 16 is passed from the first end portion 14 through the neck-shaped portion 5 to the exterior, where it is connected to a further contact member 29 on the outer surface 23 of the reflector portion 2.

What is claimed is:

1. An electric lamp/reflector unit comprising:

a molded reflector body provided with a reflector portion with a focus and an optical axis, and with a neck-shaped portion and a light emission window which is transverse to the optical axis, and an electric lamp provided with a light-transmitting lamp vessel and an electric element, the electric lamp being fixed in the reflector body with the electric element in the focus and on the optical axis, wherein the reflector body is manufactured from a glass-ceramic material with a coefficient of thermal expansion of between $-2\times10^{-6}$ $K^{-1}$ and $3\times10^{-6}$ $K^{-1}$ and the electric lamp is manufactured from quartz glass, and the ratio of the coefficient of thermal expansion of the glass-ceramic material to the coefficient of thermal expansion of the quartz glass is between −3.33 and +5.

2. An electric lamp/reflector unit as claimed in claim 1, wherein the reflector body is manufactured from a glass-ceramic material having a coefficient of thermal expansion of between $1\times10^{-6}$ $K^{-1}$ and $2\times10^{-6}$ $K^{-1}$ and the ratio of the coefficient of thermal expansion of the glass-ceramic material to the coefficient of thermal expansion of the quartz glass is between 1.67 and 3.33.

3. A method of manufacturing an electric lamp/reflector unit comprising the steps of:

forming a light-transmitting electric lamp vessel of quartz glass, forming a reflector body of a glass-ceramic material, the reflector body comprising a focus, an optical axis and a neck portion, controlling the coefficient of thermal expansion of the glass-ceramic material in the reflector body at a value between $-2\times10^{-6}$ $K^{-1}$ and $3\times10^{-6}$ $K^{-1}$ and between $2.6\times10^{-6}$ $K^{-1}$ less and $2.4\times10^{-6}$ $K^{-1}$ more than the coefficient of thermal expansion of the quartz glass of the electric lamp vessel, positioning the electric lamp vessel in the neck portion at the focus on the optical axis of the reflector body, and joining the electric lamp vessel to the reflector body.

4. The method of claim 3 in which the step of forming the reflector body comprises molding the reflector body of a multiphase system, and the step of controlling the coefficient of thermal expansion comprises bringing the reflector body to a crystallization temperature and holding the reflector body at said temperature until a degree of crystallization to achieve the coefficient of thermal expansion between $-2\times10^{-6}$ $K^{-1}$ and $3\times10^{-6}$ $K^{-1}$ and between $2.6\times10^{-6}$ $K^{-1}$ less and $2.4\times10^{-6}$ $K^{-1}$ more than the coefficient of thermal expansion of the quartz glass of the electric lamp vessel, has been obtained.

5. The method of claim 3 in which the coefficient of thermal expansion of the glass-ceramic material is controlled to be between $1\times10^{-6}$ $K^{-1}$ and $2\times10^{-6}$ $K^{-1}$.

6. A method of manufacturing an electric lamp/reflector unit which comprises: controlling a coefficient of thermal expansion of a glass-ceramic reflector body at a value dependent upon a coefficient of thermal expansion of a quartz glass electric lamp vessel.

* * * * *